United States Patent [19]

Hirakura et al.

[11] 4,389,972

[45] Jun. 28, 1983

[54] TONER CONCENTRATION CONTROL APPARATUS

[75] Inventors: Koji Hirakura, Yokohama; Yasuo Sawada, Sayama; Kenta Watase, Tokyo; Takeshi Iijima, Yokohama, all of Japan

[73] Assignee: Ricoh Company, Ltd., Japan

[21] Appl. No.: 172,240

[22] Filed: Jul. 25, 1980

[30] Foreign Application Priority Data

Aug. 4, 1979 [JP] Japan ..... 54-99635
Nov. 14, 1979 [JP] Japan ..... 54-147545

[51] Int. Cl.[3] ..... B05C 19/00; G03G 15/09

[52] U.S. Cl. ..... 118/691; 118/658; 222/57; 222/DIG. 1

[58] Field of Search ..... 118/689, 690, 691, 712, 118/658; 222/57, DIG. 1; 356/435

[56] References Cited

U.S. PATENT DOCUMENTS

| | | | |
|---|---|---|---|
| 3,233,781 | 2/1966 | Grubbs | 118/691 X |
| 3,399,652 | 9/1968 | Gawron | 118/691 |
| 3,610,205 | 10/1971 | Rarey et al. | 118/691 |
| 3,756,192 | 9/1973 | Locklar et al. | 427/8 X |
| 4,171,909 | 10/1979 | Kramer et al. | 356/435 X |
| 4,266,141 | 5/1981 | Hirakura et al. | 118/691 X |

*Primary Examiner*—Evan K. Lawrence
*Attorney, Agent, or Firm*—Guy W. Shoup; Eliot S. Gerber; Henry T. Burke

[57] ABSTRACT

A toner concentration control system for use in electrophotographic copying machines or the like, wherein light from a single light source is simultaneously detected by two photosensors, or by two sensing portions of a single photosensor, the light striking one of the photosensors (or portions) directly and the other after being reflected from developer comprising toner and carrier particles as the developer passes a viewing window in a chute provided for the transport thereof within the copying machine, the intensity of the reflected light being inversely proportional to the concentration of toner in the developer, whereby, by comparison of the output of the photosensors (or portions) by conventional means, the concentration of toner in the developer can be determined and adjusted, the photosensors (or portions) having been carefully selected as a pair of their essentially identical characteristics and response to ambient conditions so that, for example, their parallel deterioration with time or their identical response to changes in temperature will not adversely affect the accuracy of the toner-concentration determination, the portion of the embodiment comprising the light paths, the photosensors, the light source and the external surface of the viewing window being completely sealed from the remainder of the interior of the copying machine, thereby eliminating the adverse affects on measurement and long-term reliability of inevitable airborne particles of developer.

4 Claims, 9 Drawing Figures

TONER CONCENTRATION CONTROL APPARATUS

BACKGROUND OF THE INVENTION

The present invention relates to a toner concentration control apparatus for an electrophotographic copying machine, electrostatic recording apparatus or the like, for controlling the concentration of toner in the supply of a developer comprising at least toner and carrier, by optically sensing the toner concentration of the developer, and more particularly to a toner concentration control apparatus having photosensing means responsive to light reflected from the developer, and replenishing toner to the developer on the basis that the reflectivity of the developer depends upon the relative proportions of toner and carrier in the developer, the higher the concentration of toner, the lower the reflectivity of the developer, and vice versa, whereby the toner concentration of the developer is controlled accurately.

The development apparatus wherein such a toner concentration control apparatus is located applies toner to a latent electrostatic image-bearing photoconductor, forming a visible image on the photoconductor. In electrophotographic copying machines, for example, the surface of the latent electrostatic image bearing photoconductor is continuously brought very close to, or into actual contact with, the toner held in the development apparatus, which toner has been electrically charged to a polarity opposite to that of the latent electrostatic image. In the case of two-component-type developer consisting essentially of toner and carrier, when the toner is mixed with the carrier in the development apparatus, the toner particles become charged triboelectrically and cling to the surfaces of the carrier particles.

In order to produce satisfactory copies, it is necessary that the proper ratio of toner to carrier be maintained. However, each time a copy is made, some toner is used for imaging and thus depleted from the supply, and the images produced on subsequent copies will be fainter (at first not noticeably so, but increasingly as more copies are made) unless quantities of toner are added to the developer to replace that which has been used.

In order to eliminate this shortcoming, the development apparatuses of conventional electrophotographic copying machines can be provided with toner concentration control means which operate toner replenishing devices for adding toner to the developer when necessary. Generally, a toner concentration control means comprises a toner mixing-ratio detection means for detecting the ratio of toner to carrier in the developer, and a toner replenishment decision means, which compares the output signal from the toner mixing-ratio detection means with a reference signal indicating, for example, the desired concentration, and which actuates the toner replenishing device in accordance with the decision of the decision means.

An example of such toner concentration control apparatus is disclosed in Japanese Patent Publication No. 38-17245. In the toner concentration control apparatus disclosed, light from a light source is projected onto the developer held in the reservoir, and the light reflected from the developer is detected by a photosensor element. Thereafter, in accordance with the intensity of the reflected light, toner is replenished. This toner concentration control apparatus has proved to be entirely unsatisfactory, since, if the intensity of light from the light source varies due to some variation in the power or for other reasons, the output of the light-receiving photosensor element will be affected. Further, if the photosensor element changes in characteristics, for example, due to age or change in the ambient temperature, its output may also vary. Therefore, the change in the concentration of toner in the developer cannot be detected accurately by the toner concentration control apparatus disclosed in Japanese Patent Publication No. 38-17245.

Furthermore, in this type of toner concentration control apparatus, smearing of the photosensor element with developer, which is apt to be scattered out of the developer reservoir, is a serious problem causing inaccurate measurement of the toner concentration. Nothing is mentioned as a countermeasure for eliminating such drawbacks in Japanese Patent Publication No. 38-17245.

Another example of a toner concentration control apparatus, which is an improvement on the above-mentioned Japanese Patent Publication No. 38-17245 to some extent, is disclosed in U.S. patent publication No. 3,756,192. In this apparatus, a chopper wheel, which serves as a calibrated reflector, having a value of reflectance on its blades equal to that of developer of the desired toner concentration, is rotated in front of a single light source. Light is thus alternately reflected from the developer containing toner and from the calibrated reflector, to a photosensor. When an imbalance of toner in the developer results in a difference in reflected light intensity between the developer and reflector, the difference is converted into an electrical signal having an AC component. A phase-sensing circuit detects the position of the peak of the AC signal component with reference to the position of the calibrated reflector and provides a control signal to a toner replenishing device. This toner concentration control apparatus has an advantage over the aforementioned prior-art toner concentration control apparatus in that utilization of a single light source and a calibrated reflector for reference compensates for variations in output of the light source. However, this toner concentration control apparatus requires a device for rotating the chopper wheel, i.e., the calibrated reflector, which makes the toner concentration control apparatus complex in mechanism, over-sized and expensive. Furthermore, since it contains movable portions, those movable portions may be abraded while in use over an extended period of time, with the result that the reliability of the apparatus may be lowered.

Furthermore, in this toner concentration control apparatus disclosed in U.S. patent publication No. 3,756,192, the calibrated reflector and the photosensor are susceptible to smearing by the airborne toner particles, since they are not protected from the toner particles.

A still further type of toner concentration control apparatus, disclosed in U.S. patent publication No. 3,233,781, issued to W. J. Grubbs, utilizes the difference in reflectivity exhibited by toner and carrier particles as a means for monitoring the concentration of toner particles in the developer. According to the Grubbs disclosure, the reflectance of the developer is monitored by directing light from a light source toward the developer and detecting the light reflected from the developer by use of a photosensor. Such photosensor, together with a similar photosensor which is illuminated directly by the same light source and thereby provides a reference signal, is employed as a variable resistance arm of a bridge circuit which is capable of activating a toner replenishing device in response to a predetermined change in the ratio of photosensor outputs, such change being characterized by an imbalance in the circuit.

This toner concentration control apparatus has not proven entirely satisfactory in operation, since, as can be better understood from the disclosure itself, airborne toner particles are free to circulate in parts of the apparatus, while other parts thereof are relatively sealed. This allows accumulation of toner particles on the window shielding the lamp from the portion of the apparatus where the primary photosensor is located (while the reference photosensor is within the same housing as the lamp), and also allows accumulation of toner on the primary photosensor, both of which accumulations of toner serve to cause inaccurate readings as between the two photosensors, and thus inaccurate measurements of the toner concentration.

Further, in this toner concentration control apparatus, fluctuations in the intensity of the output of the lamp itself can be compensated for. However, only the lamp and the reference photosensor are enclosed within a housing so as to be free from ambient light. The reference photosensor is not similarly enclosed and will, therefore, sense ambient light present in the toner concentration control apparatus, causing error uncompensated for in the measurement of the toner concentration.

A further toner concentration control apparatus of the type which senses toner concentration by sensing variations in reflectivity of the developer is disclosed in U.S. patent publication No. 3,830,401. In this toner concentration control apparatus, pulses of radiation (i.e., light), periodically produced by a radiation source at a selected frequency, are directed at the developer mixture and the reflectance thereof is monitored by a photoelectric transducer which produces a first output signal representative of the intensity of such reflectance. A second photoelectric transducer illuminated directly through the airborne toner cloud in the apparatus by the radiation source produces a second output signal representative of the intensity of the radiation emanating from the source as modulated by the surrounding environment. The toner concentration is detected by comparing the first output with the second output and, in accordance with the result of the comparison, toner is replenished to the developer when necessary, whereby the concentration of toner in the developer is controlled. In this apparatus, variations in output of the radiation source can be compensated for, since the radiation source is shared by the two photoelectric transducers. However, this apparatus requires a pulse generator for energizing the radiation source to produce pulses of radiation at a selected frequency, which is very expensive.

Furthermore, in this toner concentration control apparatus, the radiation source and the two photoelectric transducers are faced with the airborne toner particles circulating within the apparatus. Therefore, it has the shortcoming that uncompensated for error will be caused with respect to the radiation source and the two photoelectric transducers if they are smeared differently with the airborne toner particles.

SUMMARY OF THE INVENTION

It is therefore an object of the present invention to provide a toner concentration control apparatus for use in electrophotographic copying machines or the like, from which the adverse effects of airborne developer particles, changes in ambient conditions while in use, and deterioration of the essential elements for the detection of toner concentration are completely eliminated.

According to the present invention, light from a single light source is simultaneously detected by two photosensors, or by two sensing portions of a single photosensor, the light striking one of the photoconductors (or portions) directly (or indirectly from a reference reflection and transmission means) and the other after being reflected from developer comprising toner and carrier particles as the developer passes a viewing window in a chute provided for the transport thereof within the development apparatus of a copying machine. The light source and the two photosensors (or the single photosensor) are supported by a rigid support means fixed to the chute and which forms a multichannel light path for the light source therein, and the light path, the light source, the photosensors and the external surface of the viewing window are all sealed from the surrounding environment by the support means.

Furthermore, because the two photosensors or the two light receiving portions of the single photosensor are substantially identical in characteristics including response to ambient conditions and deterioration thereof with time, the accuracy of the toner concentration determination can be maintained with long-term stability.

DETAILED DESCRIPTION OF THE PREFERRED EMBODIMENTS

Figure 1:
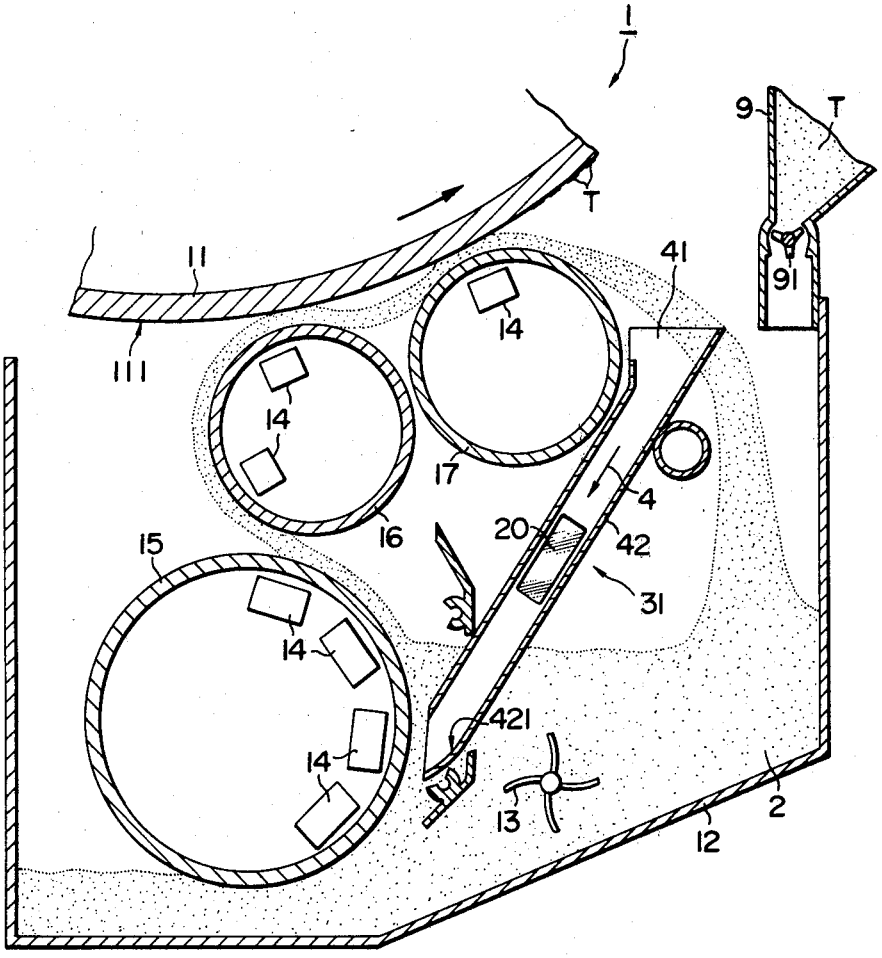
FIG. 1 shows schematically a development apparatus of a conventional electrophotographic copying machine, in which an embodiment of a toner concentration control apparatus according to the present invention is employed.
Figure 2:
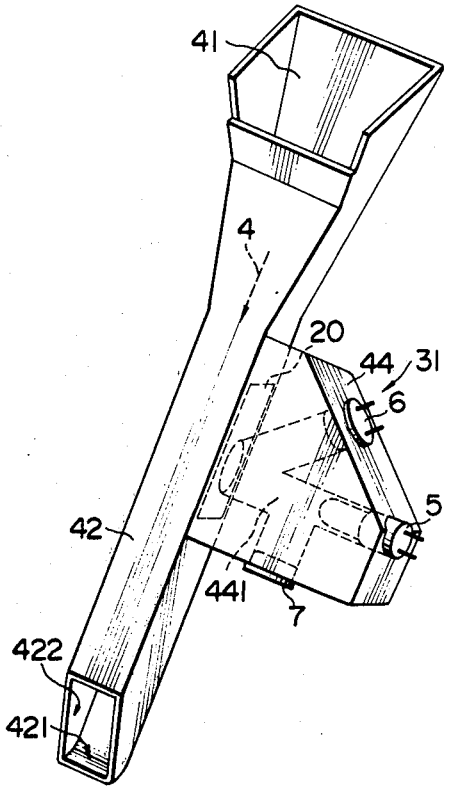
FIG. 2 is a perspective view of a toner concentration detection apparatus of the toner concentration control apparatus in FIG. 1.
Figure 3:
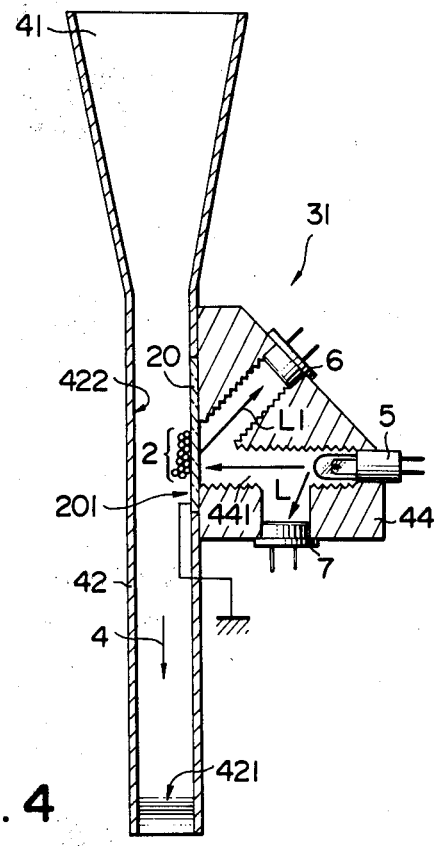
FIG. 3 is a cross section of the toner concentration detection apparatus in FIG. 2.
Figure 5:
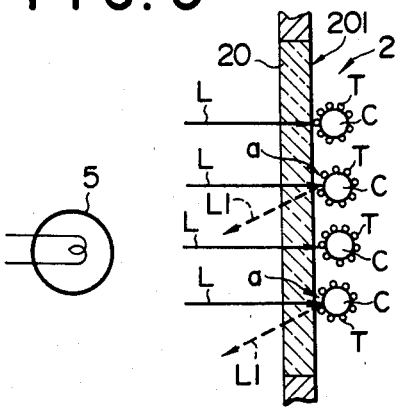
FIG. 5 is an enlarged cross section of a viewing window and adjacent portion thereof, which is employed in the toner concentration control apparatus in FIG. 4.

Referring to FIG. 1, there is shown a development apparatus 1 of a conventional electrophotographic copying machine, in which an embodiment of a toner concentration control apparatus according to the present invention is employed. The development apparatus 1 applies developer 2 to a photoconductor drum 11 which bears a latent electrostatic image on the surface 111 thereof, corresponding to an optical image of an original document. In the development apparatus 1, a two-component type developer comprising toner T and carrier C is used (refer to FIG. 5). The toner T has been charged to a polarity opposite to that of the latent electrostatic image and is attracted to the latent electrostatic image by the electrostatic forces thereof, developing the latent electrostatic image, as the photoconductor drum 11 is rotated in the direction of the arrow in FIG. 1. The carrier C is made of finely divided metallic particles and is uniformly mixed with the toner C during the flow thereof or while stirred by a stirrer 13 within a developer reservoir 12, so that the toner particles become charged triboelectrically and cling to the surfaces of the carrier particles. The developer 2 is scooped up onto the surface of a conventional developer transfer roller 15 having magnets 14 therein, as the roller 15 is rotated. The developer 2 is then delivered onto a first development roller 16 and a second development roller 17, each of which has magnets 14 therein and is positioned in close proximity to the photoconductor drum 11, so that the developer 2 is supplied to the latent electrostatic image on the surface 111 of the photoconductor drum 11 by the two development rollers 16 and 17. The developer 2 which has not been used in the development returns to the reservoir 12. In the course of the return of the developer 2 from the development roller 17 to the reservoir 12, part of the developer 2 enters a chute member 42, following a flow path 4 of a toner concentration detection apparatus 31, which constitutes a toner concentration control apparatus 3 to which the present invention is applied. As shown in FIG. 2 and FIG. 3, the flow path 4 is formed within the chute member 42 having an upper inlet pocket 41 positioned near the development roller 17, which collects a funnel-shaped quantity of the developer 2 therein. The outlet portion of the chute member 42 is small enough to cause packed flow of the developer 2. In the central portion of the chute member 42, there is mounted a viewing window 20 made of a transparent material, an electrically grounded plate formed of "NESA" glass in this embodiment. The viewing window 20 allows light to pass therethrough into the flow path 4 and also allows the light reflected from the developer 2, which passes over the surface 201 of the transparent material of the viewing window 20 on the side of the flow path 4, to pass therethrough back again. FIG. 5 shows best the viewing window 20, in which L represents illuminating light which enters the viewing window 20 and L1 represents light which has passed through the viewing window 20 and is reflected from the developer particles. The transparent material of the viewing window 20 can be made of transparent glass or transparent resin materials.

When toner particles T or carrier particles C cling to the inner surface 201 of the viewing window 20 and stay there due to electrostatic charging, they prevent a predetermined quantity of illuminating light L from reaching the developer 2 which passes through the flow path 4 and also prevent light L1 reflected from the developer 2 from passing back again through the viewing window 20, and part of the reflected light is lost, causing inaccurate readings of the reflected light. In order to prevent this, the inner surface 201 is electrically grounded, so that the clinging of the toner particles T and carrier particles C or their buildup adjacent the viewing window 20 is prevented. The clinging of the toner particles and carrier particles to the inner surface 201 of the viewing window 20, or their buildup near the viewing window 20, can also be prevented by designing the chute member 42 in such a manner that the developer 2 itself continuously cleans the inner surface 201 by wiping such clinging developer particles off the inner surface 201 while it flows down through the flow path. In order to accomplish this, the outlet portion of the chute member 42 is made small enough to cause packed flow of the developer 2, in comparison with the upper inlet pocket 41 as aforementioned, so that the developer 2 itself continuously wipes the developer particles off the inner surface 201 of the viewing window. Further, in order to assure this, part of the side wall of the chute member 42 near its outlet portion is bent to form a bent wall 421 as shown in FIG. 2, and the chute member 42 is inclined as shown in FIG. 1 and FIG. 2, whereby the developer 2 is caused to flow through the flow path 4 in close contact with the inner wall 422 of the chute member 42.

Referring to FIG. 2 and FIG. 3, a block-formed support member 44 is attached integrally to the chute member 42. The block-formed support member 44 supports integrally a light source 4, a first photosensor element 6 and a second photosensor element 7, which constitute the toner concentration detection apparatus 31.

The support member 44 is made of a rigid material, for instance, a rigid piece of resinous material containing a black pigment. A hole 441 is formed in the support member 44 by piercing the same. The hole 441 constitutes a multichannel light path comprising three connected channels. One of the channels ends at the viewing window 20 and extends back from the viewing window 20, and in the opposite end of which the light source 5 is disposed. The second of the channels intersects the first channel at the viewing window 20 and extends therefrom at an acute angle with respect to the first channel, and at the end of which a first photosensor element 6 is disposed. The third of the channels intersects the first channel at a predetermined position between the light source 5 and the viewing window 20 and in the opposite end of which a second photosensor 7 is disposed.

The second photosensor element 7 directly receives illumination light L from the light source 5, while the first photosensor element 6 receives the reflected light L1 from the developer 2 via the viewing window 20.

The inside of the hole 441 is treated so as not to reflect light therefrom, so that unnecessary light does not enter the photosensor elements 6 and 7. Furthermore, the hole 441 is sealed completely by the viewing window 20, the two photosensor elements 6 and 7, and the light source 5, so that airborne developer is not carried into the respective channels and does not accumulate on the external surfaces of the light source 5 or photosensor elements 6 and 7 or the viewing window, assuring the long-term stability of the detection apparatus 31. The first and second photosensor elements 6 and 7 and the light source 5 can be fixed and sealed by use of an adhesive.

Figure 4:
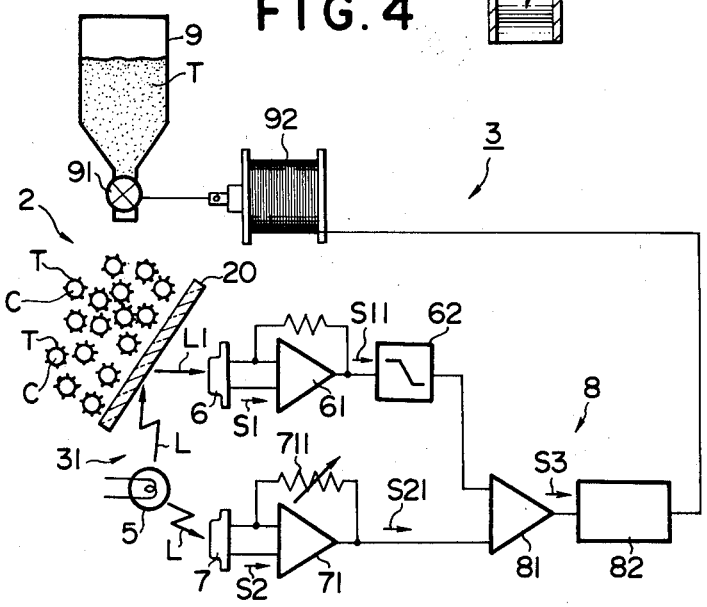
FIG. 4 is a schematic illustration of a toner concentration control apparatus to which the present invention is applied.

Referring to FIG. 4, there is schematically shown the operation of the toner concentration control apparatus 3 to which the present invention is applied. The first and second photosensor elements 6 and 7, which constitute the detection apparatus 31, are respectively connected to an amplifier 61 and an amplifier 71. The output terminals of the two amplifiers 61 and 71 are connected to a comparator 81, which constitutes a comparison and decision circuit 8. When there is a difference greater than a predetermined value between the outputs of the amplifiers 61 and 71, the comparator 81 outputs a predetermined action signal S3 to a driver 82. Upon receiving the action signal S3, the driver 82 outputs activation current to a solenoid 92, so that a valve 91 of a toner replenisher 8 is opened, adding a predetermined amount of toner T to the developer 2 and increasing the concentration of toner in the developer 2.

Referring to FIG. 5, there is shown the reflection of light L from the developer 2. The intensity of the reflected light L1 varies, depending upon the proportion of toner T and carrier C in the developer 2. The illumination light L from the light source 5 passes through the viewing window 20 and impinges on the developer 2 consisting of toner T and carrier C, adjacent to the inner surface 201 of the viewing window 20. Of the illumination light L, the portion which impinges on toner T is relatively more absorbed by the toner T, while the portion which impinges on carrier C is absorbed far less. In other words, carrier C reflects light to a greater extent than does toner T. Therefore, the lower the concentration of toner T, the higher the reflectivity of the developer 2.

The reflected light L1 is received by the first photosensor element 6 and is then converted into a detection signal S1 corresponding to the intensity of the reflected light L1. The detection signal S1 is amplified to an output voltage signal S11 at a predetermined level by the amplifier 61. The output voltage signal S11, however, contains high frequency components of voltage generated by the flow of the developer 2 over the viewing window 20. Those high frequency components do not indicate the toner concentration, and, therefore, it is desirable to eliminate them from the output voltage signal S11. Therefore, in this embodiment, a conventional high-pass filter 62 is incorporated so as to remove such high frequency components of voltage from the ourput voltage signal S11.

On the other hand, the second photosensor element 7 directly receives illumination light L from the light source 5 and produces a light intensity signal S2 in accordance with the intensity of the light from the light source 5. The light intensity signal S2 is amplified to an output voltage signal S21 by the amplifier 71. In this case, a half-mirror (not shown) can be disposed between the light source 5 and the viewing window 20, so that part of illumination light L reflected from the half-mirror is received by the photosensor element 7 and is then converted to the light intensity signal S2.

When in actual operation, the output voltage signals S11 and S21 and S21 are input to the comparator 81, where they are compared with each other. When the difference between the two voltage signals S11 and S21 or their comparison value is below a predetermined level, the activation signal S3 is not produced. However, when the comparison value exceeds the predetermined level as a result of the state of S11>S21 due to the decrease of the toner concentration below the desired level, the comparator 81 outputs the activation signal S3 to the driver 82 which has a conventional necessary circuit. The result is that the driver 82 activates the solenoid 92 to open the valve of the toner replenisher 9, so that toner T is added from the toner replenisher 9 to the developer 2. The toner replenisher 9 is in the shape of a conventional hopper and its valve 91 is opened or closed by the solenoid 92 for adding the required amount of toner T to the developer 2. When the concentration of toner T in the developer increases above the desired toner concentration, the output voltage signal S11 equals or is smaller than the output voltage signal S21 (i.e. S11≦S21). As a result, replenishment of toner T is stopped, whereby the toner concentration of the developer 2 is maintained at the desired concentration. The first and second photosensor elements 6 and 7 employed in this embodiment are carefully selected as a matching pair and are substantially the same in long-term stability, reaction to changes in temperature and other ambient conditions, and deterioration over time. Whereas, with a single photosensor as is employed in certain embodiments of the prior art, deterioration of the photosensor or changes in the ambient conditions immediately have the effect of causing an inaccurate evaluation of the toner concentration, in this embodiment of the present invention, the two photosensors respond to such changes uniformally, and the accuracy of the comparison of their respective output voltage signals S11 and S21 is not affected.

In the normal or preferred state of toner concentration, there is a certain difference in intensity between the light which reaches the first photosensor element 6 and that which reaches the second photosensor element 7 and, accordingly, there is a corresponding difference between the detection signal S1 and the light intensity signal S2, even in the optimum situation. Therefore, a variable resistor 711 of the amplifier 71 is adjusted in such a manner that the output voltage signal S11 equals the output voltage signal S21 in the case of the preferred toner concentration.

Referring to FIG. 6 through FIG. 9, there is shown another embodiment of the toner concentration control appratus according to the present invention.

Figure 6:
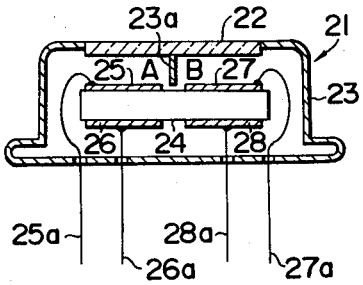
FIG. 6 is a cross section of a photosensor element which can be employed in the present invention.

FIG. 6 shows a cross section of a photosensor element 21 which can be employed in the embodiment of the toner concentration control apparatus according to the present invention. The photosensor element 21 comprises a case 23 with a viewing window 22, a photosemiconductor tip 24 enclosed in the case 23, two pairs of electrodes 25~26 and 27~28, each pair of which is sandwiched around the opposite sides of the tip 24. The electrodes 25 and 27 are transparent so as allow light to reach the tip 24. The viewing window 22 is made of a transparent material, such as a plate of glass, which is fitted into the case 23 in such a manner that nothing can enter the case 23 from outside. From the central portion of the viewing window 22, a dash-board 23*a* extends over the tip 24 and between the two electrodes 25 and 27. The dash-board 23*a* is for preventing different types of light from the viewing window 22 from entering wrong portions of the tip 24. Lead wires 25*a*, 26*a*, 27*a* and 28*a*, extend outside through their respective holes formed in the bottom portion of the case 23.

In the photosensor element 21, two light-receiving portions A and B, comprising the electrode pair 25–26 and the electrode pair 27–28, respectively, are formed on the opposite sides of the photo semi-conductor tip 24. In the photosensor element 21, the two light-receiving portions A and B are exactly the same in characteristics including reaction to changes in temperature and humidity and other ambient conditions, long-term stability, deterioration over time and photoelectric conversion.

Figure 7:
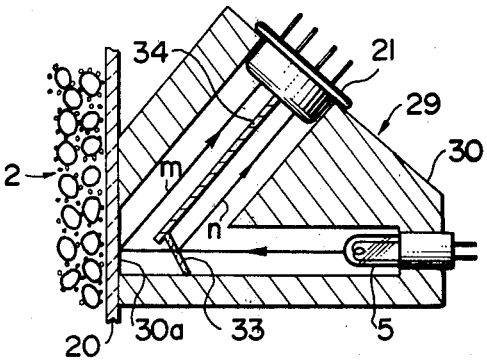
FIG. 7 is a cross section of a toner concentration detection apparatus in which the photosensor in FIG. 6. is employed.

Referring to FIG. 7, there is schematically shown an example of a toner concentration detection apparatus employing the photosensor element 21 shown in FIG. 6. In the toner concentration detection apparatus 29, a two-channel light path comprising two connected channels is formed in a block-formed container 30. The first channel ends at the viewing window 20 and extends back from the viewing window 20, and in the opposite end of which the light source 5 is disposed. The second channel intersects the first channel at the viewing window 20 and extends therefrom at an acute angle with respect to the first channel, and at the end of which the photosensor element 21 shown in FIG. 6 is disposed. Reference numeral 30*a* represents an opening portion which is tightly covered with the viewing window 20. A half-mirror 33 is disposed in the first channel between the light source 5 and the viewing window 20, near the opening portion 30*a*. In order to divide the second channel into two parallel optical paths to the photosensor element 21, a dash-board 34 extends from the half-mirror 33, parallel to the optical path formed in the second channel, to the photosensor element 21.

Part of light emitted from the light source 5 passes the half-mirror 33 and another part of the light is reflected by the half-mirror 33. The light which has passed the half-mirror 33, passing through the viewing window 20, illuninates the developer 2 behind the viewing window 20. Light m reflected by the developer 2 reaches the photosensor element 21. Light n reflected by the half-mirror 33 also reaches the photosensor element 21. However, these two reflected lights m and n are separated by the dash-board 34. By comparing the outputs of the two light-receiving portions A and B of the photosensor element 21, which are generated by those two reflected lights m and n, changes in toner concentration of the developer 2 can be detected.

Figure 8:
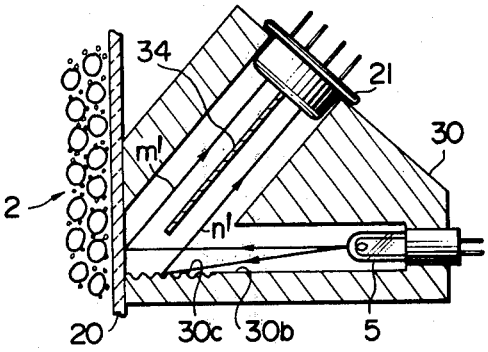
FIG. 8 is a cross section of another toner concentration detection apparatus in which the photosensor in FIG. 6 is employed.

Referring to FIG. 8, there is schematically shown another example of a toner concentration detection apparatus employing the photosensor element 21 shown in FIG. 6. Its toner concentration detection principle is the same as that of the toner concentration detection apparatus shown in FIG. 7. The only difference between them is that in the detection apparatus shown in FIG. 8, part of the surface of an innner wall 30*b* of the first channel is made rough, instead of utilizing the half-mirror 33. Reference numeral 30*c* in FIG. 8 represents such a portion with a rough surface. Light emitted from the light source 5 is reflected by the rough surface portion 30*c* in multiple, random directions and a portion thereof n′ reaches the photosensor element 21. On the other hand, light m′ which directly reaches the viewing window 20 and is reflected by the developer 2 behind the viewing window 20 also reaches the photosensor element 21. However, these two reflected lights m′ and n′ are separated by the dash-board 34. Therefore, the photosensor element 21 functions in the same manner as in the toner concentration detection apparatus shown in FIG. 7. In the toner concentration detection apparatus shown in FIG. 8, it is preferable that the reflectance of the rough surface portion 30*c* nearly equal the reflectance of the developer with the desired toner concentration, since when the toner concentration is at the desired concentration, the intensities of the lights m′ and n′ will be almost the same, so that the same two outputs can be obtained from the photosensor element 21 and, if the toner concentration deviates from the desired concentration, there occurs immediately a difference in output between the light-receiving portions A and B and, from the difference, how the toner concentration has deviated from the desired concentration can be detected immediately.

Likewise, in the toner concentration detection apparatus shown in FIG. 7, it is preferable to adjust the reflectance of the half-mirror 33 so as to be equal to the reflectance of the developer with the desired toner concentration.

Figure 9:
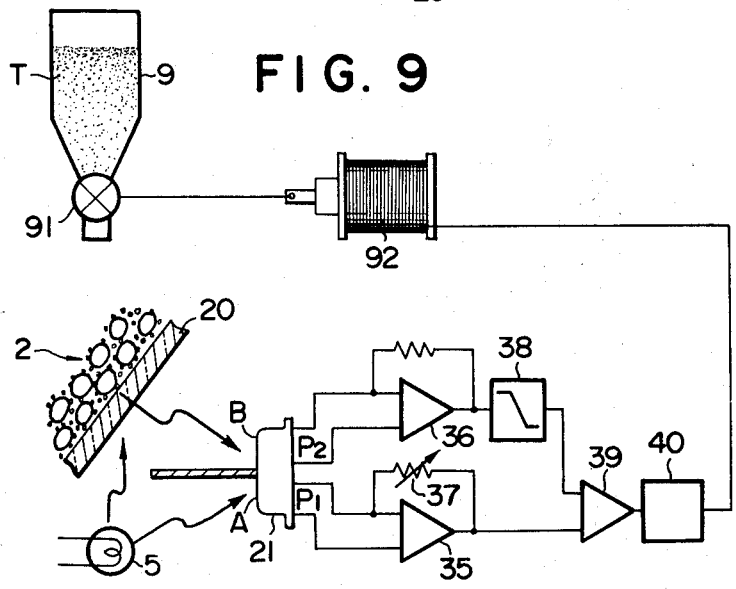
FIG. 9 is a circuit diagram of another embodiment of a toner concentration control apparatus according to the present invention.

Referring to FIG. 9, there is schematically shown an example of electric circuits for use in the aforementioned toner concentration detection apparatuses.

A portion of light from the light source 5 reaches, directly or by reflection by a member having a predetermined reflectance, the light-receiving portion A of the photosensor element 21. The light-receiving portion A produces a light current output $P_1$. On the other hand, another portion of light from the light source 5 passes through the viewing window 20 and is then reflected by the developer 2 behind the viewing window 20 and reaches the light-receiving portion B of the photosensor element 21. As a result, the light-receiving portion B produces a light current output $P_2$. The two light current outputs $P_1$ and $P_2$ are amplified by amplifiers 35 and 36, respectively. A variable resistor 37, which is connected parallel to the amplifier 35, is adjusted in such a manner that the outputs of the two amplifiers 35 and 36 become equal to each other in the normal or preferred state of toner concentration. A high cut filter 38 performs the same function as that of the high-pass filter 62 in FIG. 4. A comparator 39 and a drive circuit 40 function in the same manner as the comparator 81 and the driver 82 in FIG. 4, respectively.

In the present invention, the toner replenishing system is not limited to the hopper type replenisher with a valve as shown in FIG. 4 and FIG. 9, but other conventional systems, such as a system using a roller when replenishing toner and a system using a screw, can be employed. Further, as the light source for the present invention, tungsten lamps or light emitting diodes can be used. In particular, light emitting diodes are useful because of their high reliability. The inventors of the present invention have found a silicone diode most suitable for the light source in the present invention, due to its sufficient long-term stability and uniform temperature characteristics.

What is claimed is:

1. A toner concentration control apparatus for controlling the concentration of toner in developer comprising at least toner and carrier particles of different reflectivities for use in electrophotographic copying apparatus comprising:

chute means capable of causing the passage of developer in a packed state therethrough;

a viewing window of transparent material disposed within a portion of the body of the chute means;

a light source;

photosensing means, a first portion of which is capable of sensing light reflected by the developer as it passes the viewing window in the chute means and is illuminated by the light source and producing a first signal corresponding to the value of said reflected light, and a second portion of which is capable of sensing a reference light from the light source and producing a second signal corresponding to the value of said reference light;

rigid support means attachable to or integral with the chute means capable of supporting and enclosing the light source and the photosensing means at a predetermined position in the vicinity of the viewing window, and forming a multi-channel light path for the light from the light source therein, which light path and the light source and photosensing means and external surface of the viewing window are substantially sealed from the surrounding environment by said support means including at all points of contact between said support means and chute member;

comparator means for comparing said first and second signals produced by the photosensing means and producing an output signal;

decision means for evaluating the output signal of the comparator in comparison with a predetermined reference indicating the desired toner concentration and producing a decision signal;

dispensing means capable of dispensing toner into the developer supply; and drive means for activating and deactivating said dispensing means in accordance with the decision signal of the decision means;

wherein said first portion of said photosensing means and said second portion of said photosensing means are independently sensitive portions of a single photosensor;

said single photosensor being positioned so as to receive the light beam reflected by said developer and the light beam from said reference light;

which said two light beams follow separate optical paths so as to strike said respective portions;

and said apparatus includes reflector means to reflect the light beam of said reference light to said second portion of said single photosensor.

2. A toner concentration control apparatus as claimed in claim 1, wherein said reflector means is a combined reflecting and transmission means.

3. A toner concentration control apparatus as claimed in claim 1, wherein said reflector means is a rough light-scattering surface portion of said reference light beam light path.

4. A toner concentration control apparatus for controlling the concentration of toner in developer comprising at least toner and carrier particles of different reflectivities for use in electrophotographic copying apparatus comprising:

chute means capable of causing the passage of developer in a packed state therethrough;

a viewing window of transparent material disposed within a portion of the body of the chute means;

a light source;

photosensing means, a first portion of which is capable of sensing light reflected by the developer as it passes the viewing window in the chute means and is illuminated by the light source and producing a first signal corresponding to the value of said reflected light, and a second portion of which is capable of sensing a reference light from the light source and producing a second signal corresponding to the value of said reference light;

rigid support means attachable to or integral with the chute means capable of supporting and enclosing the light source and the photosensing means at a predetermined position in the vicinity of the viewing window, and forming a multi-channel light path for the light from the light source therein, which light path and the light source and photosensing means and external surface of the viewing window are substantially sealed from the surrounding environment by said support means including at all points of contact between said support means and chute member;

comparator means for comparing said first and second signals produced by the photosensing means and producing an output signal;

decision means for evaluating the output signal of the comparator in comparison with a predetermined reference indicating the desired toner concentration and producing a decision signal;

dispensing means capable of dispensing toner into the developer supply; and drive means for activating and deactivating said dispensing means in accordance with the decision signal of the decision means;

wherein said multi-channel light path comprises two connected channels formed in said rigid support means, the first of said channels ending at the viewing window and extending back from said viewing window, and in the opposite end of which the light source is disposed;

and the second of said channels intersecting the first of said channels at the viewing window and extending therefrom at an acute angle with respect to said first channel, said first and second portions of said photosensing means being disposed at the end of said second channel;

and said apparatus further including reflecting means in said first channel to reflect a portion of the light from said light source to the second portion of said photosensing means.

* * * * *